US008104994B1

(12) United States Patent
Donlin

(10) Patent No.: US 8,104,994 B1
(45) Date of Patent: Jan. 31, 2012

(54) SUBSOIL DRAINAGE SYSTEM

(76) Inventor: James M. Donlin, South Windsor, CT (US)

( * ) Notice: Subject to any disclaimer, the term of this patent is extended or adjusted under 35 U.S.C. 154(b) by 714 days.

(21) Appl. No.: 11/363,668

(22) Filed: Feb. 28, 2006

Related U.S. Application Data

(60) Provisional application No. 60/657,308, filed on Feb. 28, 2005, provisional application No. 60/741,502, filed on Dec. 1, 2005.

(51) Int. Cl.
*E02B 11/00* (2006.01)

(52) U.S. Cl. ..... 405/45; 405/43; 405/36

(58) Field of Classification Search ..... 405/36–51; 210/170.03, 170.08, 747
See application file for complete search history.

(56) References Cited

U.S. PATENT DOCUMENTS

| | | | | |
|---|---|---|---|---|
| 2,052,020 | A * | 8/1936 | Alexander | 405/39 |
| 4,428,841 | A * | 1/1984 | Favret, Jr. | 210/747 |
| 4,824,287 | A * | 4/1989 | Tracy | 405/36 |
| 4,880,333 | A * | 11/1989 | Glasser et al. | 405/43 |
| 6,048,131 | A * | 4/2000 | Laak | 405/43 |
| 6,485,647 | B1 | 11/2002 | Potts | 210/616 |
| 6,726,401 | B1 | 4/2004 | Potts | 405/37 |
| 6,887,383 | B2 | 5/2005 | Potts | 210/620 |
| 6,923,905 | B2 | 8/2005 | Potts | 210/143 |
| 2006/0182497 | A1 | 8/2006 | Potts | 405/46 |
| 2006/0272988 | A1 | 12/2006 | Potts | 210/170.01 |

FOREIGN PATENT DOCUMENTS

| | | | |
|---|---|---|---|
| DE | 3815443 | A1 * | 9/1988 |
| JP | 60059218 | A * | 4/1985 |
| SU | 1772313 | A1 * | 10/1992 |

* cited by examiner

*Primary Examiner* — Sunil Singh

(74) *Attorney, Agent, or Firm* — Alix, Yale & Ristas, LLP

(57) ABSTRACT

Disclosed is a PME unit comprising a support pipe disposed within an aperture of a support module. Advantageously the support pipe is disposed within the apertures of a plurality of spaced support modules. The PME unit is placed within an excavation to provide a subsoil fluid absorption system.

20 Claims, 12 Drawing Sheets

Fig. 16A
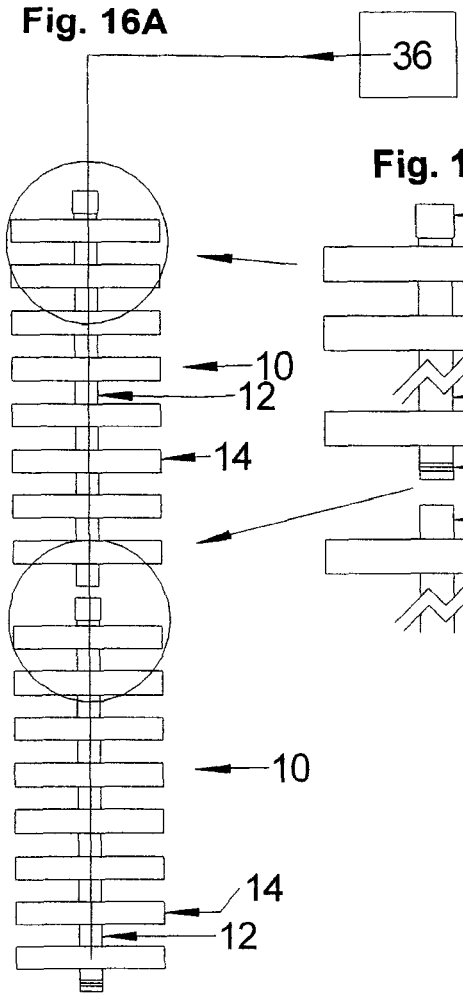
Fig. 16B
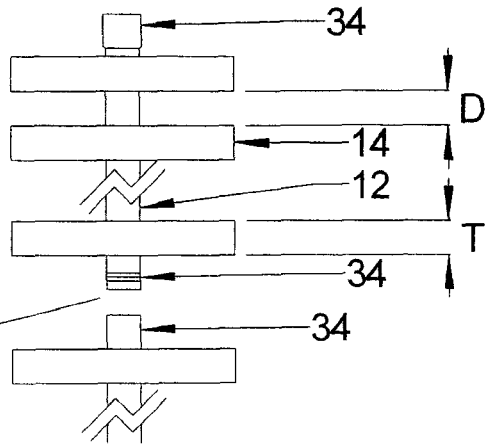
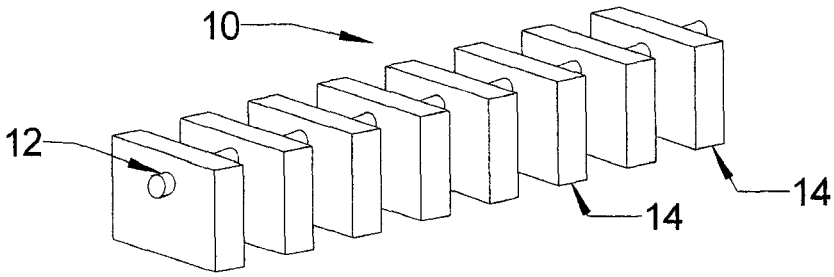
Fig. 17

SUBSOIL DRAINAGE SYSTEM

CROSS REFERENCE TO RELATED APPLICATIONS

This application claims the benefit of U.S. Provisional Application No. 60/657,308, filed Feb. 28, 2005 and U.S. Provisional Application No. 60/741,502, filed Dec. 1, 2005, the contents of each of which are incorporated by reference herein.

FIELD OF THE INVENTION

The present invention relates generally to subsoil fluid absorption and drainage systems.

BACKGROUND OF THE INVENTION

Conventional subsoil fluid absorption systems are comprised of trenches or excavations filled with small rock aggregate and overlaid with a perforated pipe. The pipe may be overlaid with a geotextile fabric and/or more rock aggregate. Soil is placed over the aggregate and perforated pipe to fill the trench to the adjoining ground level. In use, fluid flows through the pipe and out the perforations. Fluid is held within cavities in the aggregate until it can be absorbed into the soil. Other conventional systems use hollow plastic chambers placed beneath ground level to hold fluid until the fluid can flow through slits or apertures in the chamber and can be absorbed into the soil.

Current subsoil based absorption system products are limited in their design configuration, lack system flexibility and installation adaptability. For example, vertical separation may require additional fill in order to maintain adequate separation to groundwater or restrictive layers. It is also difficult for conventional systems to provide the increased bottom area and/or sidewall area required in some designs. Engineers, absorption system designers and absorption system installers are often faced with the dilemma of making the currently available products work in a nonsuitable environment. Installation of the rock aggregate also entails moving tons of aggregate from a pile and evenly distributing the aggregate into the excavation. Such movement is time consuming, requires specialized equipment and tends to destroy large parts of the surrounding lawn areas.

SUMMARY OF THE INVENTION

In one embodiment an inventive PME unit comprises a plurality of spaced support modules positioned around and longitudinally along a perforated support pipe.

In one embodiment an inventive subsoil fluid absorption system comprises a PME unit placed in an excavation or trench. A cover of geotextile fabric is placed over the PME unit and the excavation is filled with soil. A fluid path is provided between a fluid source and some or all of the modules.

The support modules provide structural integrity, flow channels and void space for the subsoil fluid absorption system. The support modules also maintain the support pipe away from the trench wall and floor. In one advantageous embodiment the support module comprises slanted walls to allow increased interfacial area between the module and the surrounding soil.

The support pipe provides structural integrity and in some embodiments internal fluid distribution into the support modules and increased volume for the subsoil fluid absorption system and a venting conduit.

The PME unit can be designed for almost any application. The PME unit can be used as part of a pressure or gravity subsoil fluid absorption system. The PME unit may be installed with vertically oriented support modules providing two different invert heights for pressure and gravity installations and increasing sidewall. The PME unit may be turned and installed with horizontally oriented support modules again providing two different invert heights and increasing area of the support module in contact with the excavation floor. PME units are easily joined together, multiplying surface areas and volume. Direction changes are accomplished with standard, off the shelf, angled pipe fittings that are connected to the support pipe. The PME unit may also be cut at any point along its length allowing installation without waste. Further, the cut sections are reusable. Some embodiments of the inventive PME unit may optionally have some of the following advantages.

- The PME unit allows engineers, designers and installers a wide variety of options not available with any other product on the market today.
- The PME unit is cleaner than stone/aggregate systems and less complicated to install than chamber systems or pipes systems.
- The PME unit is a cost effective replacement to traditional chamber, pipe or stone/aggregate systems.
- The PME unit has two low pressure pipe (LPP) distribution invert heights, primary and secondary.
- Use of PME units to form a subsoil absorption system can reduce labor and time by 50% compared to conventional stone/aggregate systems.
- The PME unit has two gravity distribution invert heights, primary and secondary.
- The PME unit allows quick and easy installations.
- Connecting PME units can be as easy as connecting standard plastic pipe.
- The PME unit allows pre-assembly of pressure or gravity configuration outside the trench
- In some embodiments the PME unit uses a triple wall perforated support pipe/distribution pipe for increased strength.
- The PME unit can have 63% more void space than conventional stone/aggregate systems.
- The support modules can have 100% wetted surface area around the entire outside edge.
- The PME unit can be 100% breathable.
- Direction change of the PME unit is accomplished with off the shelf, standard, angled pipe fittings connecting the support pipes.
- No special tools needed for installation of the PME unit.
- The PME unit can be used in trenches, at-grade, in mounds, in beds and in raised systems
- The PME unit can be used in serial distribution systems.
- The PME unit can be used in pressure or gravity systems.
- The PME unit provides improved evapotranspiration, improved evaporation, improved flow through sidewalls and increased oxygen transfer as compared to conventional stone/aggregate systems.
- The PME unit has no end plates or costly direction changing devices.
- The PME unit provides simple and effective venting in both pressure and gravity systems.
- There is no need to install more product than the design requires. The PME unit can be cut to within inches of the length needed and the cut length can be used in another application. The PME unit provides near zero product waste.

The PME unit is lightweight; in some embodiments a five-foot unit weighs approximately 8.5 lbs.

The PME unit can include a binding wire with looped ends to easily secure pipes and modules to each other.

There is substantially unrestricted fluid flow between connected PME units in some embodiments of the inventive subsoil absorption system.

Support modules comprising cuspated and flat sheets provide additional surface area for biological growth.

A better understanding of the invention will be obtained from the following detailed description of the presently preferred, albeit illustrative, embodiments of the invention.

BRIEF DESCRIPTION OF THE DRAWINGS

Other objects and advantages of the invention will be evident to one of ordinary skill in the art from the following detailed description made with reference to the accompanying drawings, in which:

FIG. 16A illustrates a schematic top plan view of one embodiment of a PME unit.

FIG. 16B illustrates expanded portions of the unit of FIG. 16A.

FIG. 17 illustrates a perspective view of one embodiment of a PME unit.

In general, the articles of the invention may be alternately formulated to comprise, consist of, or consist essentially of, any appropriate components herein disclosed. The invention may additionally, or alternatively, be formulated so as to be devoid, or substantially free, of any components, materials, ingredients, adjuvants or species used in the prior art compositions or that are otherwise not necessary to the achievement of the function and/or objectives of that embodiment.

DETAILED DESCRIPTION

With reference to FIG. 17, a PME unit 10 is formed by combining a support pipe 12 with one or more support modules, each 14 so that the support modules 14 are attached to the support pipe 12.

Figure 4:
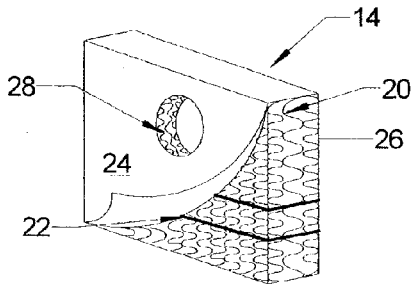
FIG. 4 illustrates a schematic perspective view of one embodiment of the support module of FIG. 1

With reference to FIG. 4, each support module 14 is constructed of any suitable sheet material of various widths and lengths. Preferably the sheet material is a polymeric material. Recycled high impact polystyrene having a thickness of 0.24 inches has been found suitable for use as a module sheet 20. The module sheets 20 are configured into flat sheets and/or egg carton shaped cuspated core sheets. Cuspated sheets are described in U.S. Pat. No. 4,880,333 the contents of which are incorporated by reference. The cuspated core sheets, alone or in combination with flat sheets are aligned in face to face orientation and joined together, for example with bands 22, to form the support module 14. Commercially available plastic banding material has been found suitable for banding the aligned module sheets 20.

Figure 41:
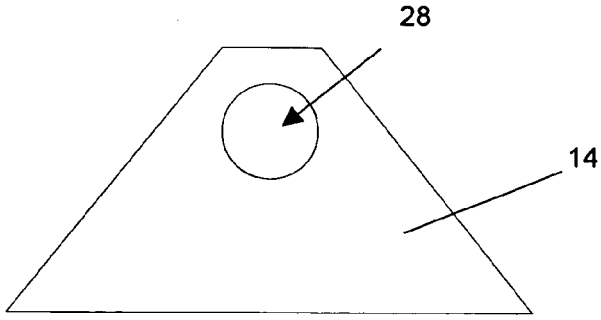
FIG. 41 illustrates a schematic end view of one embodiment of a shaped module.
Figure 42:
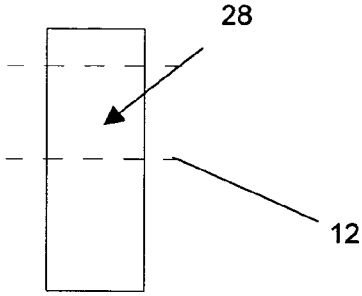
FIG. 42 illustrates a schematic side view, partly in phantom, of the shaped module of FIG. 41.
Figure 43:
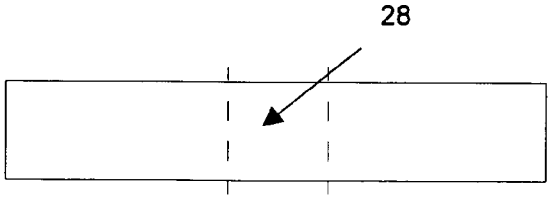
FIG. 43 illustrates a schematic top view, partly in phantom, of the shaped module of FIG. 41.

The support module 14 may be of any desired shape and are not limited to the exemplified square or rectangular shapes shown in FIG. 4. In one embodiment shown in FIGS. 41 to 43 the support module 14 has a trapezoidal shape when viewed from the end. In other embodiments (not shown) the modules may be round, oval, triangular or polygonal. Such shaped modules beneficially allow increased interfacial area between the module and the soil and improve flow of fluid from within the support module to the surrounding soil.

With reference again to FIG. 4, support module width between the exterior faces 24, 26 can also be varied to any desired dimension. An aperture 28 is provided in each sheet 20 of the support module 14. The aperture 28 is sized to receive the support pipe 12. An aperture position offset from the center of the module 10 is desirable; however the aperture 28 may be in any position relative to the module 10. Additional apertures of the same or different sizes may be provided in some or all of the sheets to accommodate additional support pipes or to increase fluid movement within the support module and through the support module sheets.

The support pipe 12 is typically a polymeric material, for example polyethylene (PE), polyvinyl chloride (PVC) or acrylonitrile-butadiene-styrene copolymer (ABS), although other materials compatible with the anticipated use may also be used. The support pipe 12 is sized appropriately to meet desired strength and fluid capacity needs. One preferred support pipe is ADS 3000© triple wall pipe available from Advanced Drainage Systems, Inc. of Hilliard, Ohio. The ADS 3000© pipe has increased stiffness and crush strength compared to other polymer pipes. In one embodiment shown in FIG. 17, the support pipe 12 is inserted through the apertures 28 of a plurality of support modules 14 to form a PME unit 10. The support pipe 12 can be solid or define one or more perforations, each 32, along some or all of its length. Advantageously, the perforations 32 coincide with the position of the support module 14 on the support pipe 12 to define a fluid path through the pipe 12 to the support module 14 as shown best in FIG. 18. The perforations and module spacing can be designed to allow fluid flow to any or all of the modules.

The PME unit is formed by placing the support pipe 12 within the apertures 28 of one, or advantageously, a plurality of support modules 14 so that the support modules 14 are spaced along, and supported by, the length of the support pipe 12.

Figure 18:
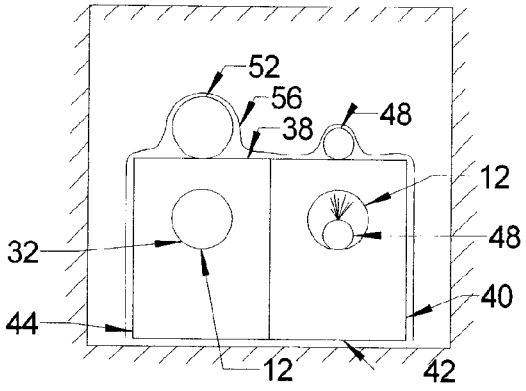
FIG. 18 illustrates a schematic cross-sectional view of one embodiment of a PME unit in an excavation.

A subsoil fluid absorption and drainage system is formed by placing one or more PME units 10 in an excavation such as shown in FIG. 18. Multiple PME units may be fluidly connected by using conventional fittings 34 to attach support pipe 12 ends from adjoining PME units 10 as shown best in FIG. 16A. The terminal end of the support pipe may be capped with a conventional fitting 34 as shown best in FIG. 16B. After backfilling of the excavation edges, 38, 40, 42 and 44, of the module 14 are typically in contact with soil. The PME units 10 may be in a series or end to end arrangement as shown in FIG. 16A, in a parallel or side by side arrangement as shown in FIG. 18 or both. The support pipes 12 of PME units 10 arranged in series can be connected using standard pipe fittings and couplings if desired.

A fluid path is provided from a fluid source 36, shown in FIG. 16A, such as a septic system distribution box or a storm water runoff, through the support pipe 12 and to some of the support modules 14. Fluid in the support module 14 will flow between the module sheets 20 out through the edges of the support module 14 and into the surrounding soil. Since the support modules 14 are constructed of essentially parallel sheets 20 of material, the fluid path from the sheet 20 to the surrounding soil is almost completely unobstructed. A geotextile cover (not shown for clarity) may enclose some or all of the support module 14. The geotextile cover, if used, is fluid permeable and does not substantially obstruct fluid flow through from the module 14 to the soil. The unobstructed fluid path allows increased fluid flow through the PME unit 10 into the surrounding soil, providing a desirable improvement over conventional chambers that restrict fluid flow therethrough to slits, holes or other restrictive openings in an impermeable chamber wall. The space between adjacent sheets 20 in the support module 14 provides storage capacity for fluid until the fluid can be absorbed into the soil contacting the support module.

Figure 28:
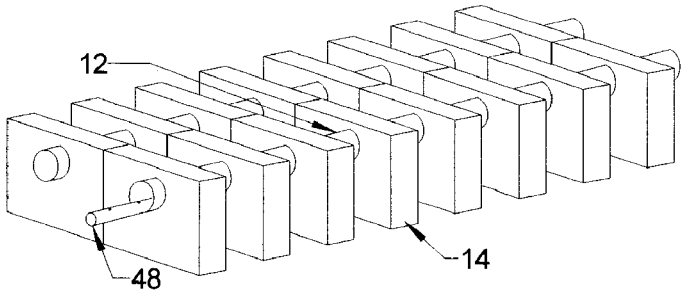
Figure 30:
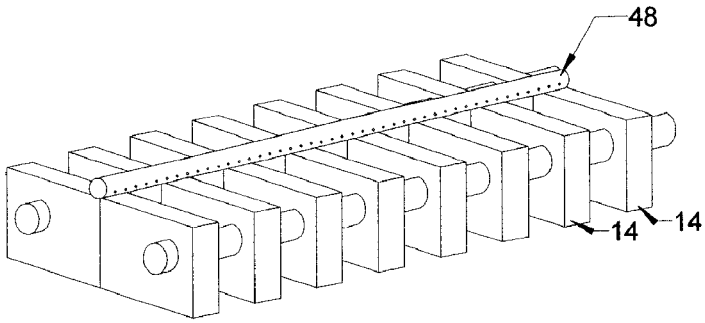

The PME unit may be used in a variety of subsoil fluid absorption and drainage systems. With reference to, for example, FIGS. 18 and 30, in a pressure subsoil fluid absorption and drainage system, fluid from a source 36 can be pumped under pressure through a Low Pressure Pipe (LPP) 48 adjacent a support module 14. The support pipe 12 does not need to be directly connected to the fluid source in this embodiment. The low pressure pipe 48 can be positioned over the top of the modules 14 as shown in FIG. 30 (LPP High Invert) so that fluid flows from apertures 50 in the Low Pressure Pipe (LPP) 48 to the adjacent a support module 14. The low pressure pipe 48 can also be disposed within the support pipe 12 (LPP Low Invert) as shown in FIGS. 18 and 28 so that fluid is discharged from apertures 50 in the Low Pressure Pipe (LPP) 48 into the support pipe 12 interior and through support pipe apertures 32 into the support module 14. Alternatively, the low pressure pipe 48 is not perforated and can be directly connected to a support pipe 12 (not shown). As used herein a direct connection can comprise conventional pipe fittings and sections of pipe between the low pressure pipe 48 and the support pipe 12 to control fluid flow from the low pressure pipe 48 to the support pipe 12. As used herein a direct connection does not encompass uncontrolled flow of fluid, for example, from a low pressure pipe aperture 50 through a support module 14 and to a support pipe 12.

Figure 19:
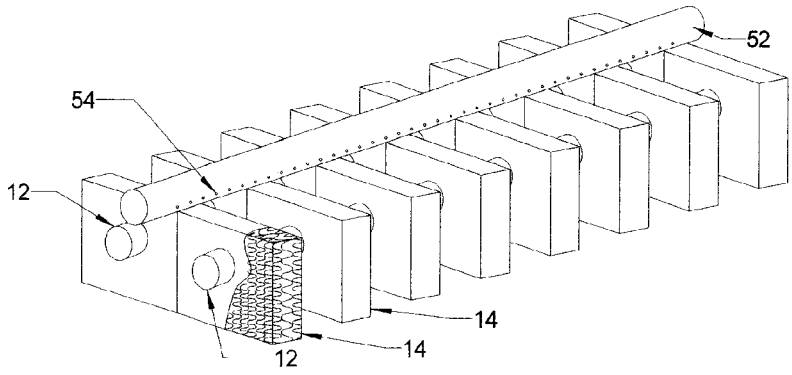
FIG. 19 illustrates a perspective view of one embodiment of a PME unit.

With reference to, for example, FIGS. 18 and 19, in a gravity subsoil fluid absorption and drainage system fluid flows by gravity from a source 36 through a gravity distribution pipe 52 to the adjacent support module 14. The support pipe 12 does not need to be directly connected to the fluid source in this embodiment. The gravity distribution pipe 52 can be positioned over the top of the modules 14 as shown in FIG. 19 (Gravity High Invert) so that fluid flows from apertures 54 in the gravity distribution pipe 52 to the adjacent a support module 14. The support pipe 12 can also be fluidly connected to the fluid source 36 as (Gravity Low Invert) so that fluid flows by gravity into the support pipe interior and through the support pipe apertures into the support modules. Alternatively, the gravity distribution pipe 52 is not perforated and can be directly connected to a support pipe 12 (not shown). The direct connection can comprise conventional pipe fittings and sections of pipe between the gravity distribution pipe 52 and the support pipe 12.

In one embodiment shown best in FIG. 18, the PME unit is placed in a previously prepared excavation so that the support pipe is generally parallel with the excavation floor and one side of the support modules contacts the excavation floor. Fluid is distributed by pressure or gravity from a source to some or all of the support modules.

In another embodiment (not shown) the PME unit is placed in a previously prepared excavation so that the support pipe is generally perpendicular with the excavation floor and the support module sides are adjacent the excavation sides. Fluid is distributed by pressure or gravity from a source to some or all of the support modules. This embodiment may be useful in drywell applications.

The subsoil fluid absorption system can have the PME unit 10 overcovered with geotextile fabric 56 as shown in FIG. 18. In this embodiment the fabric 56 keeps fill material from being placed between the support modules and the support module sheets so that a space or gap remains between the support modules. This gap provides substantial reservoir capacity to retain high volume fluid flows until the fluid can be absorbed into the adjacent soil. This gap also allows substantially unrestricted fluid transfer through the gap and between adjacent PME units.

In another embodiment (not shown) the faces, top and sides of the support module are wrapped in geotextile fabric. The support module bottom may be covered or may be left uncovered to contact the excavation floor and facilitate fluid transfer to the soil. Naturally, the fabric covering the support module faces would have apertures to allow the support pipe to be disposed within the support module. The fabric can be sewn into a formed cover and fitted over the support module. The cover, or separate fabric sections, can also be fastened to the support module by any other suitable method, for example by adhesive bonding, heat welding, stapling or banding.

If the fabric overcover exemplified in FIG. 18 is not used a fill material such as sand can be disposed in the gap between the support modules and over the interconnected PME units. In this embodiment the individually wrapped support module prevents fill material from being disposed between support module sheets 20. Fluid transfer between adjacent PME units will be somewhat restricted in this embodiment because of the fill material disposed in the gaps. In systems that comprise multiple PME units arranged in overlying or side by side configuration fluid transfer between adjacent, individually wrapped support modules can be increased by leaving the abutting edge of each adjacent module uncovered so fluid can be transferred from one uncovered edge to the abutting uncovered edge.

The exemplified PME units are linear. In other embodiments the support pipes of PME units can be connected with angle fittings to provide a nonlinear subsoil fluid absorption system comprising multiple PME units.

Having generally described the invention, the following examples are included for purposes of illustration so that the invention may be more readily understood and are in no way intended to limit the scope of the invention unless otherwise specifically indicated. It should be understood that the invention encompasses all possible configurations including, for example, modification to support module size and shape, support pipe size and configuration and PME unit size and configuration in addition to those exemplified below.

PME units were produced as described below. The material used for producing the exemplified PME units is shown in Table 1.

TABLE 1

| module sheet 20 (Cuspated Core) | | | |
|---|---|---|---|
| Property | Test Method | Unit | Minimum Average Roll Value |
| HI Polystyrene (raw) | Micrometer/ Standard | 0.024" | 0.024" |
| Cuspated Core Height | ASTM D 1777 | 1.250" | 1.250" |
| Compressive Strength | ASTM D 1621 | lbs./sq. ft. | 6,900 |
| Flow Capacity | ASTM D 4716 | gpm/sq. ft. | 15 |

| Support Pipe 12 (ADS 3000 © Triple Wall) | | | |
|---|---|---|---|
| Property | Test Method | Unit | typical value |
| HD polyethylene | Standard | feet | 10 |
| diameter | Standard | inches | 4 |
| Stiffness | ASTM D 2412 | Psi | 22 |

TABLE 1-continued

| | | | |
|---|---|---|---|
| Perforations | Standard | Dia/inches | 0.625" |
| Perforation Spacing | Standard | Inches | 3.5 |
| Perforation Degrees | Standard | Degrees | 120 |

| Band 22 | | |
|---|---|---|
| Material | Width | Thickness |
| Polypropylene | 0.500" | 0.025" |

| Geotextile Cover Fabric 56 | | | |
|---|---|---|---|
| Property | Test Method | Unit | Minimum Average Roll Value |
| Weight | ASTM D 5261 | oz/sq. yd | 5.0 |
| Grab Tensile | ASTM D 4632 | Lbs. | 130 |
| Grab Elongation | ASTM D 4632 | % | 50 |
| Trap Tear | ASTM D 4533 | Lbs. | 55 |
| Puncture | ASTM D 4833 | Lbs. | 75 |
| Mullen Burst | ASTM D 3786 | Psi | 265 |
| Permittivity | ASTM D 4491 | 1/sec | 1.7 |
| Water Flow | ASTM D 4491 | Gpm/sf. ft. | 115 |
| A.O.S. | ASTM D 4751 | U.S. sieve | 70 |
| U.V. Resistance after 150 hours | ASTM D 4355 | % strength retained. | 70 |

Figure 15:
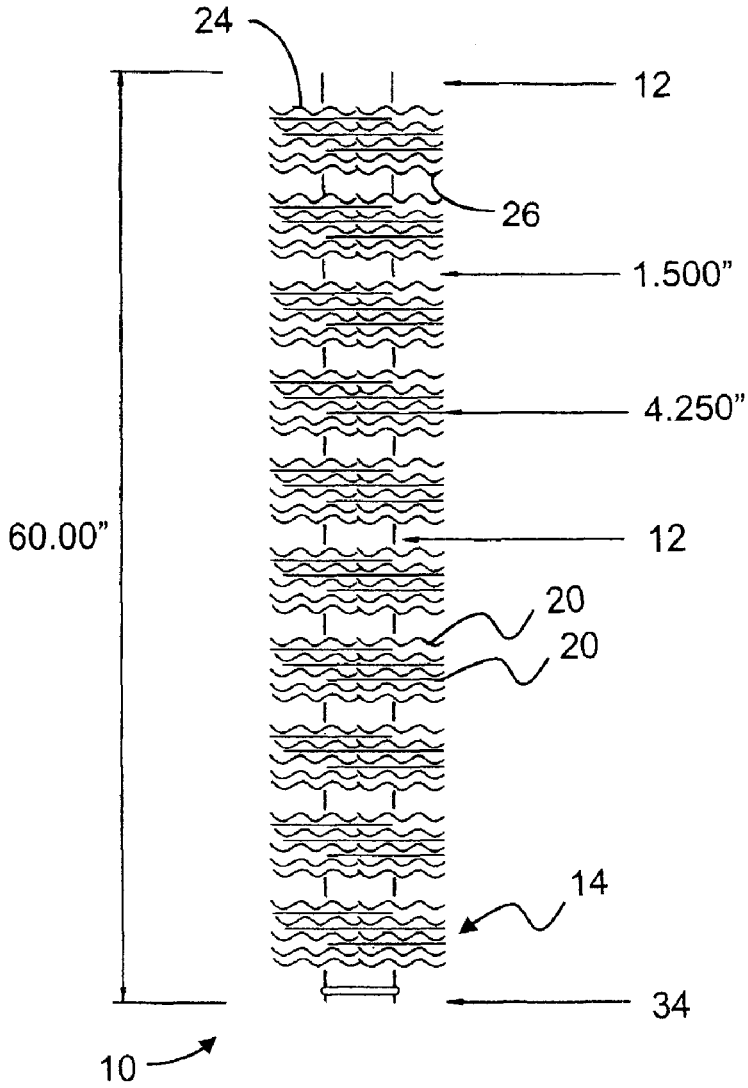
FIG. 15 illustrates a schematic top plan view of one embodiment of a PME unit.

In one embodiment shown in sheet FIG. 15 the PME unit 10 is 5 feet long. Each support module 14 is approximately 10 inches wide by 4.25 inches long by 12 inches to 14 inches high. Eight modules are spaced evenly along the 5-foot length of 4-inch diameter support pipe 12 with approximately a 1.5-inch gap between each module 14 and allowing 2 inches on either end of the support pipe 12 for placement of standard fittings.

Some additional PME unit 10 embodiments are listed in Table 2. Two PME units can provide up to 32 different installation configurations.

TABLE 2

| Configuration Widths, Heights, Inverts, Pressure & Gravity | | | | | | | | |
|---|---|---|---|---|---|---|---|---|
| Rows | Model | Width (Inches) | Height (Inches) | Length (Inches) | * LPP High Invert (Inches) | * LPP Low Invert (Inches) | ** Gravity Low Invert 4" Support pipe (Inches) | ** Gravity High Invert 4" Perforated pipe (Inches) |
| 1 | 1012-SV | 10 | 12 | 60 | 12 | 6 | 6 | 12 |
| 2 | 2012-DV | 20 | 12 | 60 | 12 | 6 | 6 | 12 |
| 3 | 1210-SH | 12 | 10 | 60 | 10 | 3 | 3 | 10 |
| 4 | 2410-DH | 24 | 10 | 60 | 10 | 3 | 3 | 10 |
| 5 | 1014-SV | 10 | 14 | 60 | 14 | 8 | 8 | 14 |
| 6 | 2014-DV | 20 | 14 | 60 | 14 | 8 | 8 | 14 |
| 7 | 1410-SH | 14 | 10 | 60 | 10 | 3 | 3 | 10 |
| 8 | 2810-DH | 28 | 10 | 60 | 10 | 3 | 3 | 10 |

* High Invert LPP - Place on top of support modues, see Installation Guidelines 10.2.
Low Invert LPP - Install inside support pipe, see Installation Guidelines 10.4.
** High Invert Gravity - Install perforated distribution pipe on top of modules, see Installation Guidelines 10.6.
Low Invert Gravity - Use perforated four-inch support pipe, see Installation Guidelines 10.8.

TABLE 3

Volume Capacity For Five-foot PME Units

| Rows | Model | Width (Inches) | Height (Inches) | Length (Inches) | * LPP High Invert (Inches) | * LPP Low Invert (Inches) | ** Gravity Low Invert 4" Support pipe (Inches) | ** Gravity High Invert 4" Perforated pipe (Inches) |
|---|---|---|---|---|---|---|---|---|
| 1 | 1012-SV | 10 | 12 | 60 | 30.6 | 16.0 | 16.0 | 30.6 |
| 2 | 2012-DV | 20 | 12 | 60 | 61.2 | 32.0 | 32.0 | 61.2 |
| 3 | 1210-SH | 12 | 10 | 60 | 30.6 | 9.4 | 9.4 | 30.6 |
| 4 | 2410-DH | 24 | 10 | 60 | 61.2 | 19.0 | 19.0 | 61.2 |
| 5 | 1014-SV | 10 | 14 | 60 | 36.0 | 31.2 | 31.2 | 36.0 |
| 6 | 2014-DV | 20 | 14 | 60 | 72.0 | 62.4 | 62.4 | 72.0 |
| 7 | 1410-SH | 14 | 10 | 60 | 36.0 | 11.0 | 11.0 | 36.0 |
| 8 | 2810-DH | 28 | 10 | 60 | 72.0 | 22.0 | 22.0 | 72.0 |

1012 Family, Some Alternative Embodiments

Figure 22:
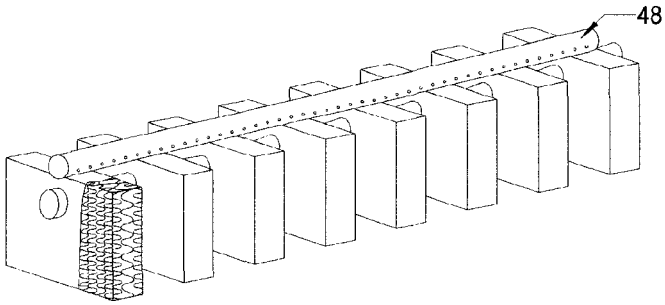
Figure 23:
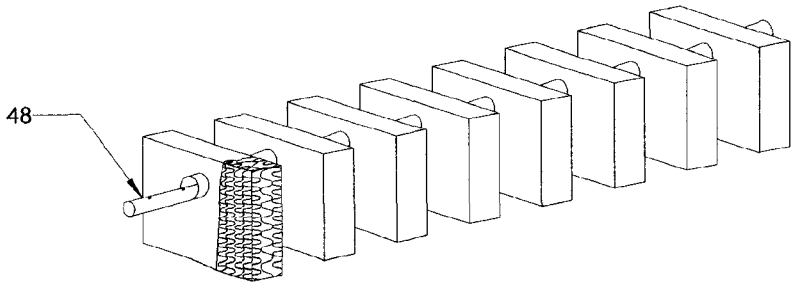
Figure 25:
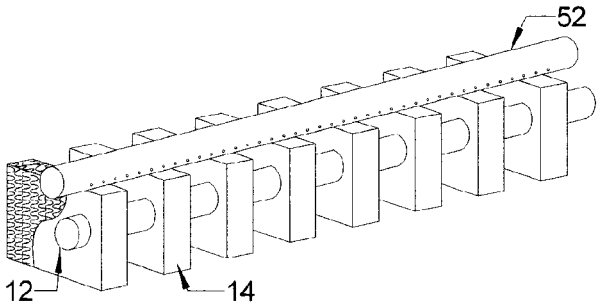

The 1012-SV PME unit shown for example in FIGS. 1, 17 and 20-21 comprises a plurality of modules 14 in spaced relationship along the length of a support pipe 12. The modules are in a vertical position with a width of ten inches and a height of twelve inches. The two LPP invert heights are based on either placing the low pressure pipe 48 on top of the support modules 14 (see for example FIG. 22) or within the support pipe 12 (see for example FIG. 23). When the low pressure pipe 48 is placed on the support modules 14 it may be centered or offset to either side. The two gravity invert heights are based on either placing the gravity distribution pipe 52 on top of the support modules 14 (see for example FIG. 25) or using the support pipe 12 to distribute the fluid (see for example FIG. 17). In a gravity system the gravity distribution pipe 52 for the high invert option may be offset to either side support modules 14. The support pipe apertures 32 are preferably at the 5:00 & 7:00 o'clock positions.

Figure 1:
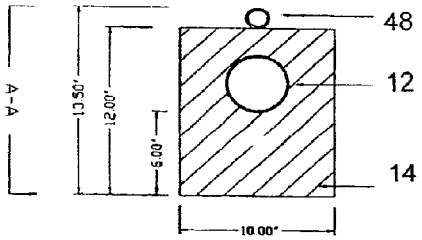
FIG. 1 illustrates a schematic end view of one embodiment of a PME unit with vertically oriented support modules.
Figure 2:
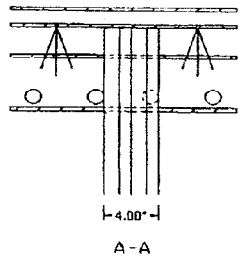
FIG. 2 illustrates a schematic cross-sectional view of the unit of FIG. 1
Figure 3:
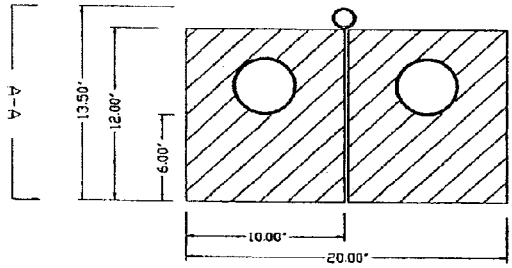
FIG. 3 illustrates a schematic end view of one embodiment of a PME unit.
Figure 20:
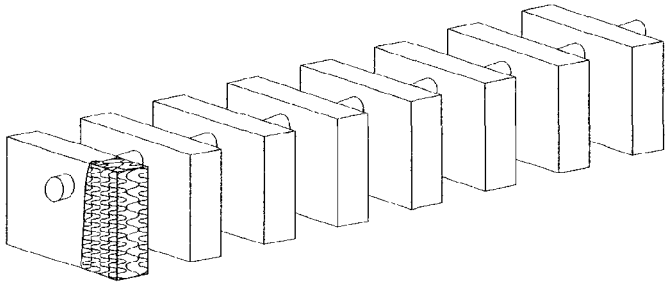
FIGS. 20 to 31 illustrate perspective views of some embodiments of PME units.
Figure 21:
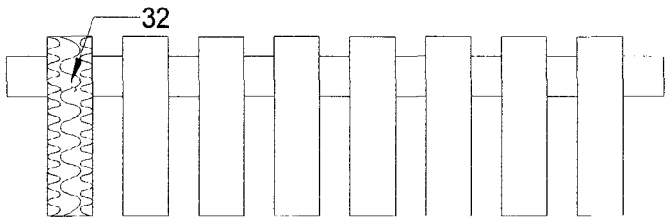
Figure 26:
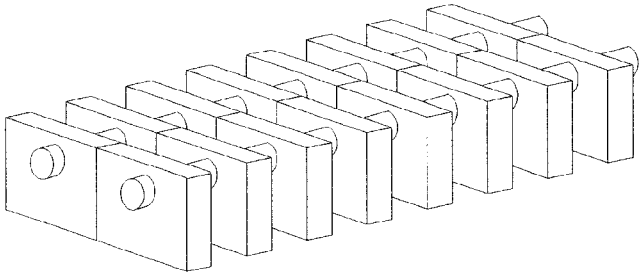
Figure 27:
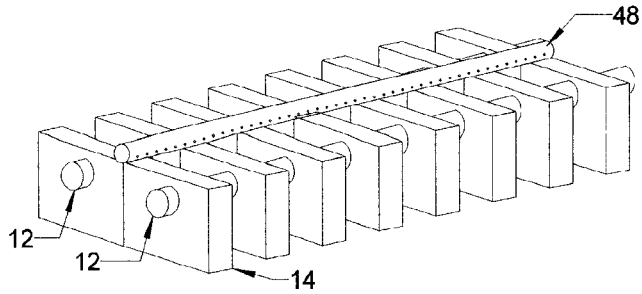
Figure 29:
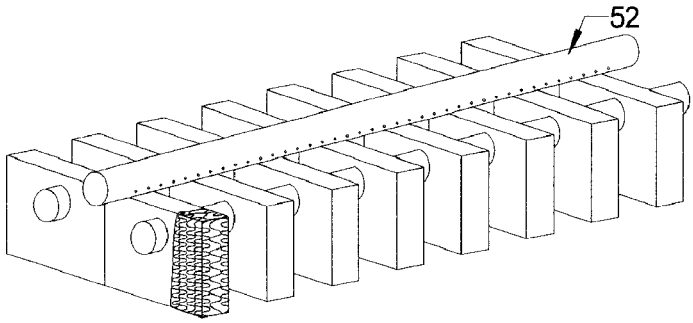

The 2012-DV PME unit shown for example in FIGS. 3 and 20 comprises a doubled side by side configuration of the 1012-SV embodiment. The modules are in a vertical position. The 2012-DV PME unit thereby doubles the bottom surface area width and void space as compared to the 1012 embodiment. The two LPP invert heights are based on either placing the low pressure pipe 48 on top of the support modules 14 (see for example FIG. 27) or within one or both of the support pipes 12 (see for example FIG. 28). When the low pressure pipe 48 is placed on the support modules 14 it may be centered or offset to either side. The two gravity invert heights are based on either placing the gravity distribution pipe 52 on top of the support modules 14 (see for example FIG. 29) or using one or both of the support pipes 12 to distribute the fluid (see for example FIG. 26). In a gravity system the gravity distribution pipe 52 for the high invert option may be offset to either side support modules 14. The support pipe apertures 32 are preferably at the 5:00 & 7:00 o'clock positions.

Figure 5:
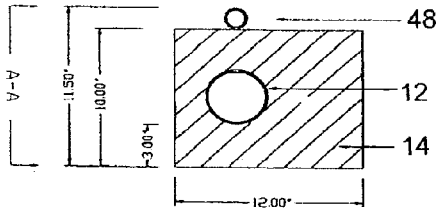
FIG. 5 illustrates a schematic end view of one embodiment of a PME unit with horizontally oriented support modules.
Figure 6:
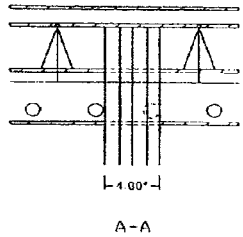
FIG. 6 illustrates a schematic cross-sectional view of the unit of FIG. 5.
Figure 24:
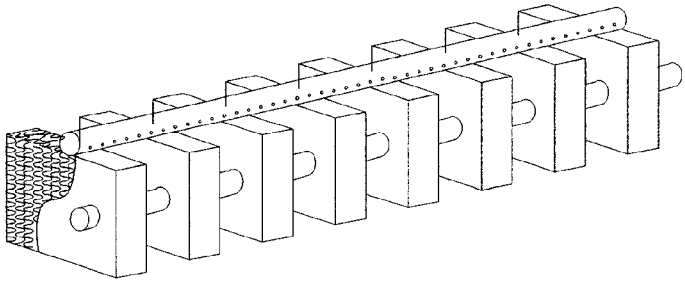

The 1210-SH PME unit shown in FIG. 5 comprises a plurality of modules 14 in spaced relationship along the length of a support pipe 12. The modules are in a horizontal position with a width of twelve inches and a height of ten inches. The two LPP invert heights are based on either placing the low pressure pipe 48 on top of the support modules 14 (see for example FIG. 24) or within the support pipe 12 (not shown). When the low pressure pipe 48 is placed on the support modules 14 it may be centered or offset to either side. The two gravity invert heights are based on either placing the gravity distribution pipe 52 on top of the support modules 14 (see for example FIG. 25) or using the support pipe 12 to distribute the fluid (not shown). In a gravity system the gravity distribution pipe 52 for the high invert option may be offset to either side support modules. The support pipe apertures 32 are preferably at the 5:00 & 7:00 o'clock positions.

Figure 7:
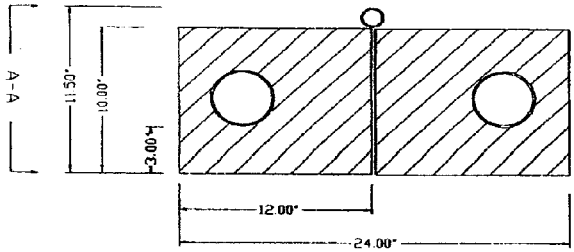
FIG. 7 illustrates a schematic end view of one embodiment of a PME unit.
Figure 31:
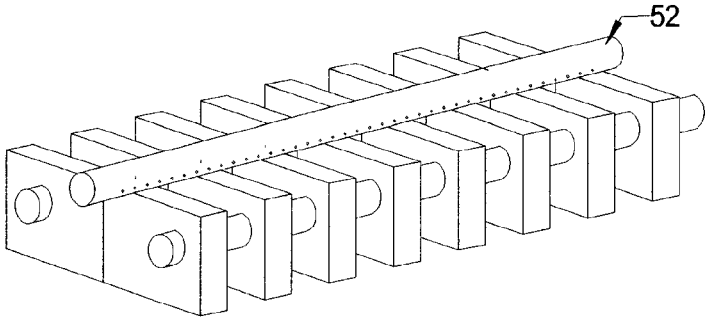
Figure 32:
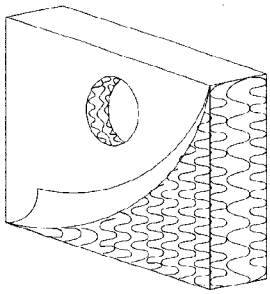
FIG. 32 illustrates perspective view of one embodiment of a support module in the vertical position.
Figure 33:
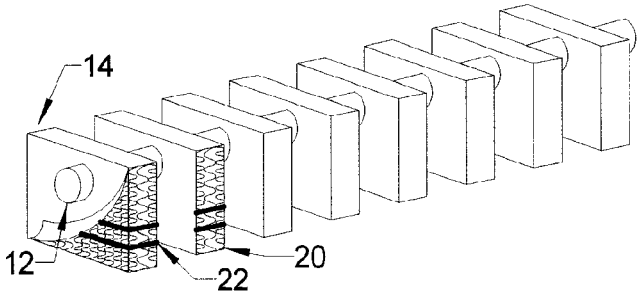
FIG. 33 illustrates a perspective view of a portion of one embodiment of a PME unit.
Figure 34:
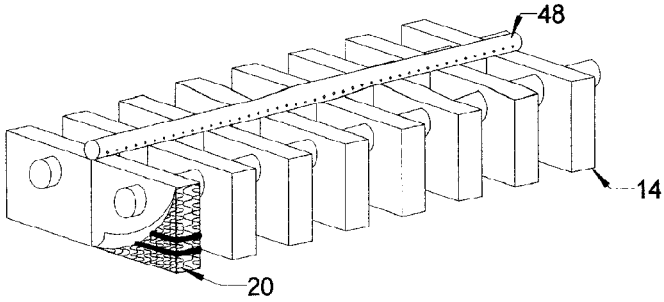
FIGS. 34 to 40 illustrate perspective views of some embodiments of PME units.
Figure 35:
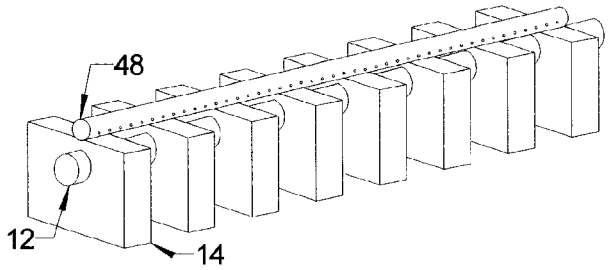
Figure 36:
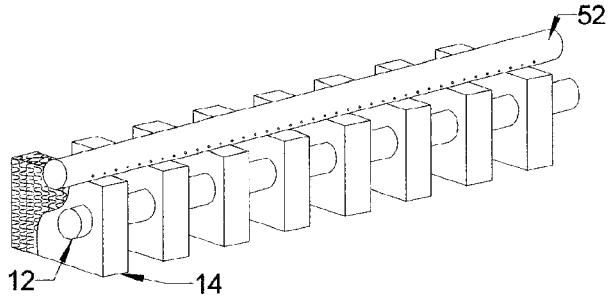
Figure 37:
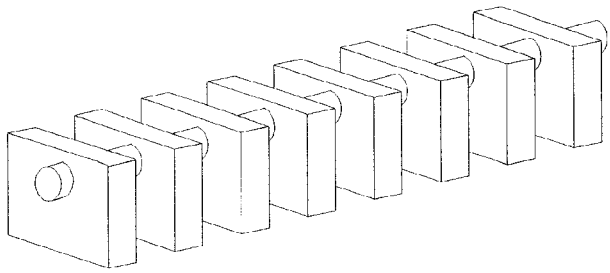
Figure 38:
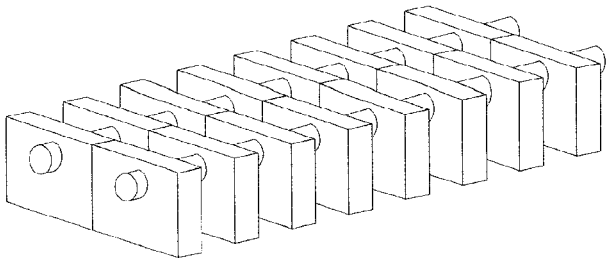
Figure 39:
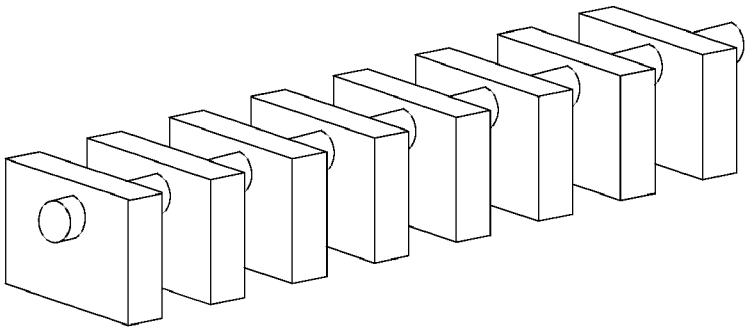
Figure 40:
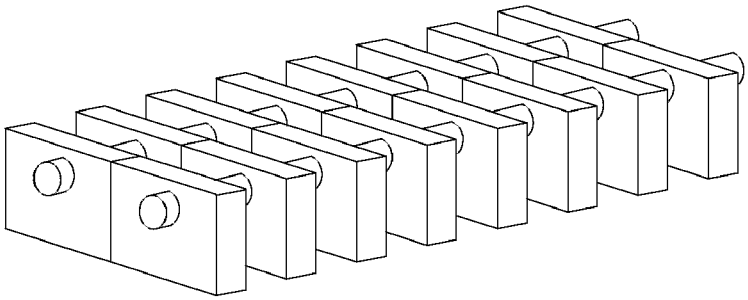

The 2410-DH PME unit shown in FIGS. 7 and 30-31 comprises a doubled side by side configuration of the 1210-S embodiment. The modules are in a horizontal position with a width of twenty-four inches and a height of ten inches. The 2410-DH PME unit thereby doubles the bottom surface area width and void space as compared to the 1210 embodiment. The two LPP invert heights are based on either placing the low pressure pipe 48 on top of the support modules 14 (see for example FIG. 30) or within one or both of the support pipes 12 (not shown). When the low pressure pipe 48 is placed on the support modules 14 it may be centered or offset to either side. The two gravity invert heights are based on either placing the gravity distribution pipe 52 on top of the support modules 14 (see for example FIG. 31) or using one or both of the support pipes 12 to distribute the fluid (not shown). In a gravity system the gravity distribution pipe 52 for the high invert option may be offset to either side support modules 14. The support pipe apertures 32 are preferably at the 5:00 & 7:00 o'clock positions.

1014 Family, Some Alternative Embodiments

Figure 8:
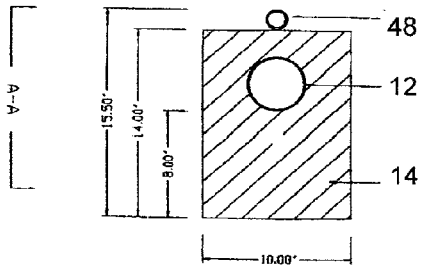
FIG. 8 illustrates a schematic end view of one embodiment of a PME unit with vertically oriented support modules.
Figure 9:
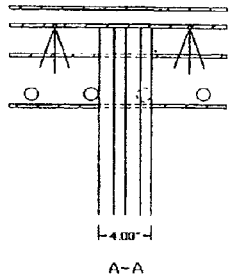
FIG. 9 illustrates a schematic cross-sectional view of the unit of FIG. 8

The 1014-SV PME unit shown in FIG. 8 comprises a plurality of modules 14 in spaced relationship along the length of a support pipe 12. The modules are in a vertical position with a width of ten inches and a height of fourteen inches. The two LPP invert heights are based on either placing the low pressure pipe 48 on top of the support modules 14 or within the support pipe 12. When the low pressure pipe 48 is placed on the support modules 14 it may be centered or offset to either side. The two gravity invert heights are based on either placing the gravity distribution pipe 52 on top of the support modules 14 or using the support pipe 12 to distribute the fluid. In a gravity system the gravity distribution pipe 52 for the high invert option may be offset to either side support modules 14. The support pipe apertures 32 are preferably at the 5:00 & 7:00 o'clock positions.

Figure 10:
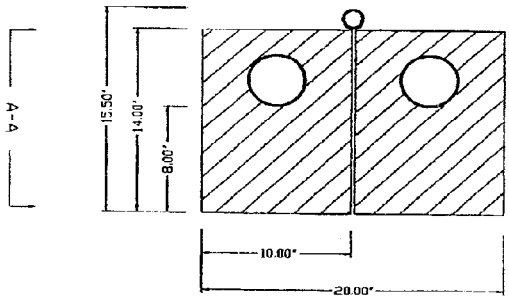
FIG. 10 illustrates a schematic end view of one embodiment of a PME unit.
Figure 11:
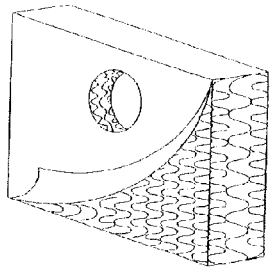
FIG. 11 illustrates a schematic perspective view of one embodiment of the support module of FIG. 8

The 2014-DV PME unit shown in FIG. 10 comprises a doubled side by side configuration of the 1014-SV embodiment. The modules 14 are in a vertical position with a bottom area width of twenty inches and a height of fourteen inches. The two LPP invert heights are based on either placing the low pressure pipe 48 on top of the support modules 14 or within one or both of the support pipes 12. When the low pressure pipe 48 is placed on the support modules 14 it may be centered or offset to either side. The two gravity invert heights are based on either placing the gravity distribution pipe 52 on top of the support modules 14 or using one or both of the support pipes 12 to distribute the fluid. In a gravity system the gravity distribution pipe 52 for the high invert option may be offset to either side support modules 14. The support pipe apertures 32 are preferably at the 5:00 & 7:00 o'clock positions.

Figure 12:
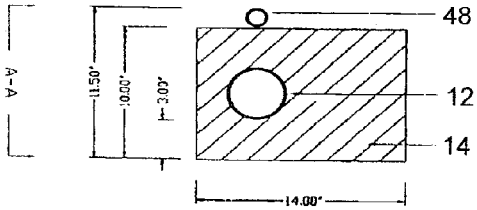
FIG. 12 illustrates a schematic end view of one embodiment of a PME unit with horizontally oriented support modules.
Figure 13:
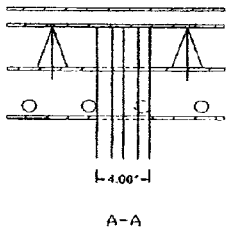
FIG. 13 illustrates a schematic cross-sectional view of the unit of FIG. 12.

The 1410-SH PME unit shown in FIG. 12 comprises a plurality of modules 14 in spaced relationship along a support pipe 12. The modules are in a horizontal position with a width of fourteen inches and a height of ten inches. The two LPP invert heights are based on either placing the low pressure pipe 48 on top of the support modules 14 or within the support pipe 12. When the low pressure pipe 48 is placed on the support modules 14 it may be centered or offset to either side. The two gravity invert heights are based on either placing the gravity distribution pipe 52 on top of the support modules 14 or using the support pipe 12 to distribute the fluid. In a gravity system the gravity distribution pipe 52 for the high invert option may be offset to either side support modules. The support pipe apertures 32 are preferably at the 5:00 & 7:00 o'clock positions.

Figure 14:
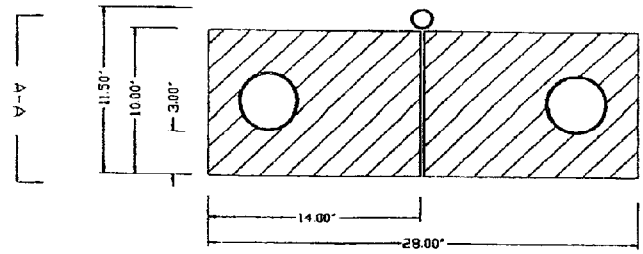
FIG. 14 illustrates a schematic end view of one embodiment of a PME unit.

The 2810-DH PME unit shown in FIG. 14 comprises a doubled, side by side configuration of the 1410-S embodiment. The modules 14 are in a horizontal position with a bottom area width of twenty-eight inches and a height of ten inches. The two LPP invert heights are based on either placing the low pressure pipe 48 on top of the support modules 14 or within one or both of the support pipes 12. When the low pressure pipe 48 is placed on the support modules 14 it may be centered or offset to either side. The two gravity invert heights are based on either placing the gravity distribution pipe 52 on top of the support modules 14 or using one or both of the support pipes 12 to distribute the fluid. In a gravity system the gravity distribution pipe 52 for the high invert option may be offset to either side support modules. The support pipe apertures 32 are preferably at the 5:00 & 7:00 o'clock positions.

Selected Installation Guidelines for Placement of Some PME Unit Embodiments into a Subsoil Based Absorption System.

1.0 Excavated Trench Width

Ensure that space remains for placement of geotextile fabric to drape over the sides of each PME unit or row and that sufficient room remains for backfilling either side. Advantageously, at least three inches of cover fabric should lay flat on bottom of trench so that it can be secured in place during backfilling.

2.0 Excavate Trench Distance

The PME unit 10 can be cut at any position between the support modules 14. This will allow the trench to be excavated to within six-inches of the required length. The cut off sections are reusable in other lines or in a future installation.

3.0 Assembly

The PME unit 10 may be assembled inside or outside of the trench depending on preferences and site situation.

4.0 Connecting

Depending on regulatory requirements the perforated support pipes 12 may be glued or simply pushed together.

5.0 Direction Change

Direction changes are accomplished easily and quickly by using standard, off the shelf fittings on the support pipe 12 end. 90°, 45°, 22.5°, T, TY, and Y fittings are readily available from most local suppliers.

6.0 Cut to Length

The PME unit support pipe 12 may be cut at any location between two adjacent support modules 14. Cutting the pipe 12 in the center of the spaced location is preferred as this will allow any type of standard fitting to be pushed on to the support pipe 12 cut end for venting or direction changes. The support modules 14 may be slightly pushed back along the support pipe 12 to accommodate these standard fittings.

7.0 Venting

One end of a 90° fitting is installed at the end of a support pipe 12. A non-perforated pipe is connected to the other end of the 90° fitting. The non-perforated pipe length is chosen to extend above ground level after backfilling the excavation and thereby provide a vent 60 to the surface. Venting may be installed any where along the system by cutting the perforated support pipe 12 and installing the appropriate fittings, for example a T fitting connecting the cut support pipe ends and the non-perforated pipe.

If the increased gravity distribution method is used, (Installation Guideline 11.5) both the support pipe 12 and the gravity distribution pipe 52 may be vented if necessary.

If the increased LPP method is used, (Installation Guideline 10.0) and the PME unit 10 is vented anywhere other than the end of the unit, than the LPP 48 will need to be offset to one side or the other to allow room for the vertical placement and extension of the vent pipe.

8.0 Geotextile Covering

In some embodiments a breathable, fluid permeable geotextile fabric overcover 56 can be used with the PME units. In embodiments where the support modules 14 are individually covered with geotextile fabric no additional overcover is necessary.

9.0 Backfilling

Begin backfilling by hand shoveling or sloughing clean backfill material along the sides of the PME units 10. Care should be taken to ensure that the geotextile fabric overcover 56 is secured by soil weight or compaction to the bottom of the trench at either side of the unit, see FIG. 18. Once this is accomplished direct over the top backfilling may be conducted.

Backfill material is preferably clean, porous native soil or fill material devoid of large rocks. Divert surface runoff with diversion ditches or berms. Finish grade excavated areas to prevent surface runoff from collecting on system disposal area. Seed excavated areas to protect against erosion. It is suggested not to drive or pave over backfilled PME units and the subsoil absorption area.

Selected Installation Guidelines for Alternate Configurations of Some PME Unit Embodiments into a Subsoil Based Absorption System.

10.2* High Invert/Low Pressure Pipe (LPP) Distribution

For most installations the low pressure pipe (LPP) 48 is disposed over, and centered on, the support modules 14 with apertures 50 offset and directed at the support pipe 12 or toward the adjacent support module 14. If a vent pipe 60 is being installed to the support pipe 12 the LPP 48 may need to be offset to one side depending on the location point of the vent pipe 60. The LPP 48 can be secured by tie wraps, twine or baling wire to any of the bands 22 on one or more support modules 14.

10.4* Low Invert/Low Pressure Pipe (LPP) Distribution

A second option for sites or installations that require a shallower invert height is to place the LPP 48 directly into the support pipe 12 with apertures 50 facing up. Drain holes (not shown) facing down are advantageously incorporated at the end and middle of each LPP 48

10.6** Low Invert, Gravity Distribution

If the perforated support pipe 12 is used perforation 32 locations are pre-set by the manufacture and are typically placed in the 5:00 & 7:00 o'clock positions.

10.8** High Invert Gravity Distribution

Place a perforated gravity distribution pipe 52 along the top of the support modules 14. Ensure gravity distribution pipe apertures 54 are at the 5:00 & 7:00 o'clock positions. The distribution pipe 52 is advantageously secured by tie wraps, twine or baling wire to bands 22 on one or more of the support modules 14 or directly around the support pipe 12.

Doubled PME Units—Vertical or Horizontal 11.0 When utilizing doubled configurations several methods may be used to attach units together. These methods are used to hold the units in place during the backfilling operation. Minimum soil weight will effectively hold the units. For ease of construction it is preferred to attach units prior to setting the unit(s) in the trench.

Option 1

Place the units 10 side by side in the desired configuration. At the center of each unit in the open gap between supports modules 14 wrap duct tape to pull and securely fasten units 10 together. Twine, rope or baling wire may also be used.

Option 2

Place the units 10 side by side in the desired configuration. Each support module 14 has both vertical and horizontal bands 22. Using, for example, string, twine or bailing wire, tie around bands 22 on one support module 14 to the adjoining support module 14.

In any configuration and depending on the user's preference it may be easier to pre-assemble several PME units 10 together prior to fastening the PME units to each other. Support pipes may be joined using couplers and glued together to provide a more rigid section for handling purposes.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. A PME unit comprising:

a plurality of support modules, each having opposing faces and an aperture defined therein, each face having a height; and a support pipe comprising a wall defining a plurality of spaced apertures, the pipe defining an axis and being positioned within the aperture of each support module so that the support pipe apertures and the support modules are aligned;

wherein each support module comprises a plurality of generally parallel polymer sheets and is axially spaced apart from adjacent support modules along the support pipe defining a void between the modules with only said support pipe positioned therebetween.

2. The PME unit of claim 1 wherein the support pipe is fluidly connected to the support modules.

3. The PME unit of claim 1 wherein the support modules have slanted walls.

4. The PME unit of claim 1, wherein each support module is axially space apart from adjacent support modules by less than 6 inches.

5. The PME unit of claim 1, wherein each support module is axially spaced apart from adjacent support modules by a distance within the range of 1-5 inches.

6. The PME unit of claim 1, wherein each support module is axially spaced apart from adjacent support modules by a distance within the range of 1.5-3.5 inches.

7. The PME unit of claim 1, comprising a secondary pipe positioned within the support pipe.

8. The PME unit of claim 7, wherein the secondary pipe comprises a wall defining at least one secondary aperture and said secondary pipe is connected to a fluid source and configured to discharge fluid from said at least one secondary aperture into the support pipe.

9. The PME unit of claim 8, comprising more than two support modules, wherein the distance between respective adjacent support modules is not the same.

10. A PME unit comprising:

a first support module including a plurality of module sheets arranged in face to face orientation, each module sheet defining an aperture therein, each sheet aperture being aligned to define a module aperture extending from a first face of the module to an opposing second face of the module;

a second support module including a plurality of module sheets arranged in face to face orientation, each module sheet defining an aperture therein, each sheet aperture being aligned to define a module aperture extending from a first face of the module to an opposing second face of the module; and a first support pipe defining an axis and apertures therein positioned within the first support module aperture and the second support module aperture, the first support pipe defining a fluid path from a first end to an opposing second end, wherein the second module first face is axially spaced from the first module second face along the support pipe defining a void therebetween with only a portion of the support pipe positioned axially therebetween and one of the support pipe apertures is located between the first support module first and second faces, another of the support pipe apertures is located between the second support module first and second faces and there is a fluid path between the first support module, the first support pipe and the second support module.

11. The PME unit of claim 10 wherein one of the module sheets defines a second aperture therein.

12. The PME unit of claim 10 wherein the support modules each comprise a triangular or trapezoidal shape.

13. The PME unit of claim 10 further comprising:

a fluid conduit fluidly connectable to a fluid source, the fluid conduit disposed in fluid communication with the first support pipe.

14. The PME unit of claim 10 further comprising:

a fluid conduit fluidly connectable to a fluid source, the fluid conduit disposed over an edge of the first support module; and a direct connection between the fluid conduit and the first support pipe.

15. The PME unit of claim 10 wherein the support modules comprise cuspated module sheets.

16. The PME unit of claim 10, wherein the second module first face is axially spaced from the first module second face by a distance within the range of 1-5 inches.

17. The PME unit of claim 1, wherein the second module first face is axially spaced from the first module second face by a distance within the range of 1.5-3.5 inches.

18. A PME unit comprising:

a plurality of support modules, each having opposing faces, an aperture defined therein and an interior volume; and a support pipe defining an axis positioned within the aperture of each support module and being fluidly connected to the interior volume of the support modules; wherein each support module comprises a plurality of polymer sheets and is axially spaced apart from adjacent support modules along the support pipe defining a void between the modules with only said support pipe positioned therebetween.

19. The PME unit of claim 18, wherein said adjacent support modules are each axially spaced apart by a distance within the range of 1-5 inches.

20. The PME unit of claim 18, wherein said adjacent support modules are each axially space apart by a distance within the range of 1.5-3.5 inches.

* * * * *

UNITED STATES PATENT AND TRADEMARK OFFICE

CERTIFICATE OF CORRECTION

PATENT NO. : 8,104,994 B1
APPLICATION NO. : 11/363668
DATED : January 31, 2012
INVENTOR(S) : James M. Donlin It is certified that error appears in the above-identified patent and that said Letters Patent is hereby corrected as shown below:

Column 14, line 45:

Delete "1" and insert --10--.

Signed and Sealed this
Thirteenth Day of March, 2012

David J. Kappos

David J. Kappos
*Director of the United States Patent and Trademark Office*